US006941850B1

(12) United States Patent
McMahon

(10) Patent No.: US 6,941,850 B1
(45) Date of Patent: Sep. 13, 2005

(54) SELF-CONTAINED AIRBORNE SMART WEAPON UMBILICAL CONTROL CABLE

(75) Inventor: Roy Patrick McMahon, Indianapolis, IN (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/754,153

(22) Filed: Jan. 9, 2004

(51) Int. Cl.[7] ..... F41F 3/055

(52) U.S. Cl. ..... 89/1.811; 89/1.55; 89/1.56; 701/3

(58) Field of Search ..... 89/1.55, 1.56, 89/1.6, 1.811, 1.814; 244/3.1, 3.12; 701/3

(56) References Cited

U.S. PATENT DOCUMENTS

| | | | | |
|---|---|---|---|---|
| 5,414,347 | A * | 5/1995 | Monk et al. | 324/73.1 |
| 5,443,227 | A * | 8/1995 | Hsu | 244/3.12 |
| 5,541,839 | A | 7/1996 | Mitzkus et al. | 244/3.16 |
| 5,548,510 | A | 8/1996 | Ebert et al. | 364/443 |
| 5,942,713 | A * | 8/1999 | Basak | 89/1.816 |
| 5,992,290 | A * | 11/1999 | Quebedeaux et al. | 89/1.56 |
| 6,122,569 | A | 9/2000 | Ebert et al. | 701/3 |
| 6,615,116 | B2 * | 9/2003 | Ebert et al. | 701/3 |
| 2004/0015273 | A1 * | 1/2004 | Leonard et al. | 701/3 |

FOREIGN PATENT DOCUMENTS

GB 2 132 794 A * 7/1984

OTHER PUBLICATIONS

'Joint Direct Attack Munition (JDAM) Design.' Global Security.org, p. 1-4 [retrieved online Nov. 5, 2003]. http://www.globalsecurity.org/military/systems/munitions/jdam-design.htm.

'What's New With Smart Weapons' Global Security.org. p. 1-4 [retrieved online Nov. 5, 2003]. http://www.globalsecurity.org/military/system/munitions/intro-smart.htm.

* cited by examiner

*Primary Examiner*—Stephen M. Johnson
(74) *Attorney, Agent, or Firm*—Renner, Otto, Boisselle & Sklar, LLP

(57) ABSTRACT

An umbilical cable for delivering electrical signals between an aircraft and a smart weapon carried by the aircraft. The umbilical cable includes cabling comprising a plurality of conductive wires, a first connector provided on one end of the cabling and configured to connect to the aircraft, and a second connector provided on the other end of the cabling and configured to connect to the smart weapon. The umbilical cable further includes an interface circuit electrically coupled between the first connector and the second connector via the plurality of conductive wires. The interface circuit is configured to receive via the first connector a non-standard combination of signals comprising at least one of data signals, control signals and power signals not receivable directly by the smart weapon to carry out operations. Moreover, the interface circuit is configured to convert the non-standard combination of signals to a set of signals receivable by the smart weapon to carry out operations, and to provide the set of receivable signals to the smart weapon via the second connector.

26 Claims, 7 Drawing Sheets

SELF-CONTAINED AIRBORNE SMART WEAPON UMBILICAL CONTROL CABLE

TECHNICAL FIELD

The present invention relates generally to aircraft and aircraft weaponry. More specifically, the present invention relates to an umbilical cable for connecting a smart weapon to an aircraft not otherwise equipped to handle the smart weapon.

BACKGROUND OF THE INVENTION

"Smart" weapons, also referred to as precision guided munitions (PGMs), alter their trajectories in flight to seek, or home on, their targets. Unlike conventional ballistic munitions, their accuracy does not normally diminish as range increases. Generally speaking, smart weapons are divided into four categories, according to their method of homing: command guidance, active, semiactive, and passive. Munitions using command guidance are steered to the target by a remote system or operator that performs all target acquisition, tracking, and guidance functions. Active systems home on their targets using emissions transmitted by the munition itself. Semiactive smart weapons home on energy bounded off the target by an external transmitter, usually aboard the launch platform. Passive systems home on energy emitted by the target.

Some smart weapons do not fit cleanly in the above typology. For example, the Tomahawk missile does not actually home on the target but uses on-board radar to generate midcourse guidance corrections for its inertial navigation system. ALCM missiles fly to a precise set of coordinates using an inertial guidance system updated by Global Positioning System satellite transmissions.

Newly produced tactical aircraft are designed to carry and deploy such smart weapons. This, for example, has led to a dramatic reduction in the collateral damage associated with conventional "dumb bombs". The smart weapons typically are secured on a bomb rack which is mounted either in a bomb bay or to pylons under the wing of the aircraft. An electrical cable, known as an "umbilical cable", couples the aircraft to a respective smart weapon on the bomb rack. The umbilical cable typically runs from the bomb bay support structure or pylon to the smart weapon itself.

The umbilical cable serves as an electrical connection for delivering power and exchanging data between the aircraft and the smart weapon. The smart weapons typically are designed to accept power, data and control information from the aircraft in order to carry out operations. The aircraft, on the other hand, are designed to provide the appropriate power, data and control information to the umbilical cable via the pylon.

For example, newly produced tactical aircraft are internally wired with the MIL-STD-1553 databus for coupling to the MIL-STD-1760 standard weapons interface. Smart weapons such as the Joint Direct Attack Munition (JDAM) are designed to communicate with the aircraft via such interface to obtain information from the aircraft such as coordinate data, etc., in order to carry out operations.

Unfortunately, there is a significant number of older aircraft that are still in use today but are not properly equipped to handle smart weapons. For example, such aircraft may not include the MIL-STD-1553 databus and thus are unable to communicate with a smart weapon such as the JDAM. Replacing the older aircraft, which are otherwise perfectly functional, is extremely expensive considering the cost of modern military aircraft. However, even retrofitting an older aircraft to include the necessary wiring (e.g., databus) and sophisticated avionics to provide the necessary information to a smart weapon is very costly. Consequently, many older aircraft today remain unable to handle smart weapons and therefore their operators cannot make use of the advantages associated therewith.

In view of the aforementioned shortcomings, there remains a strong need in the art for means to enable aircraft not equipped to handle smart weapons to nevertheless do so.

SUMMARY OF THE INVENTION

According to one aspect of the invention, an umbilical cable is provided for delivering electrical signals between an aircraft and a smart weapon carried by the aircraft. The umbilical cable includes cabling comprising a plurality of conductive wires, a first connector provided on one end of the cabling and configured to connect to the aircraft, and a second connector provided on the other end of the cabling and configured to connect to the smart weapon. The umbilical cable further includes an interface circuit electrically coupled between the first connector and the second connector via the plurality of conductive wires. The interface circuit is configured to receive via the first connector a non-standard combination of signals comprising at least one of data signals, control signals and power signals not receivable directly by the smart weapon to carry out operations. Moreover, the interface circuit is configured to convert the non-standard combination of signals to a set of signals receivable by the smart weapon to carry out operations, and to provide the set of receivable signals to the smart weapon via the second connector.

According to another aspect of the invention, provided is a method of loading operation data into a smart weapon configured to be loaded on an aircraft. The method includes the step of providing an umbilical cable, the umbilical cable having cabling with a plurality of conductive wires, a first connector provided on one end of the cabling and configured to connect to the aircraft, and a second connector provided on the other end of the cabling and configured to connect to the smart weapon. In addition, the umbilical cable includes an interface circuit electrically coupled between the first connector and the second connector via the plurality of conductive wires. The interface circuit is configured to receive via the first connector a combination of signals comprising at least one of data signals, control signals and power signals not receivable directly by the smart weapon to carry out operations, to convert the combination of signals to a set of signals receivable by the smart weapon to carry out operations, and to provide the set of receivable signals to the smart weapon via the second connector. The method further includes the steps of temporarily connecting at least one of the first connector and the second connector to a ground loading device, and transmitting the operation data from the ground loading device to the umbilical cable and storing the operation data within the umbilical cable.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
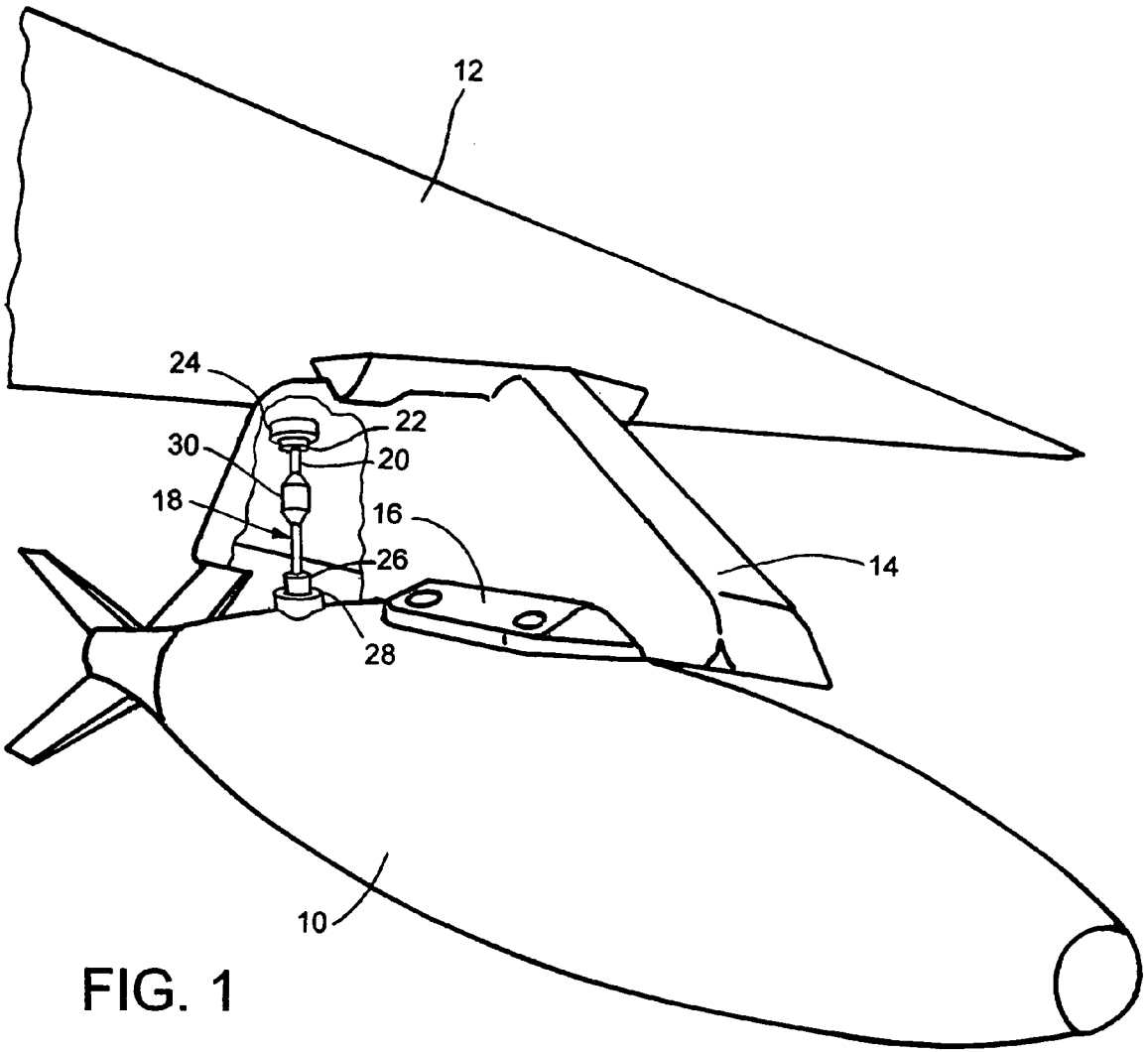
FIG. 1 is an environmental view in partial cutaway illustrating a smart weapon umbilical cable in accordance with the present invention coupling a smart weapon to an aircraft.

The present invention will now be described in detail with reference to the drawings, in which like reference numerals are used to refer to like elements throughout.

The present invention relates to an umbilical cable for connecting a smart weapon to an aircraft that is not otherwise equipped to handle the smart weapon. Referring initially to FIG. 1, a smart weapon 10 is shown mounted to the wing 12 of an aircraft. As is typical, the wing 12 includes one or more pylons 14 secured to the underside of the wing 12. Each pylon typically supports a bomb rack 16 used to secure various types of weapons.

In accordance with the present invention, the weapon 10 is a smart weapon, i.e., one capable of altering its trajectory in flight to seek, or home on, its target. In an exemplary embodiment described herein, the smart weapon 10 is a JDAM or other MIL-STD-1760 type smart weapon. However, it will be appreciated that the smart weapon 10 could be any other type of smart weapon without departing from the scope of the invention.

According to the invention, the aircraft is electrically coupled to the smart weapon 10 via an umbilical cable 18. The umbilical cable 18 couples power, control and/or data signals between the aircraft and the smart weapon 10 which allow the smart weapon 10 to carry out its operations. For example, the aircraft may provide power and target coordinate data to the smart weapon 10. The smart weapon 10 may, in turn, provide status information, etc., to the aircraft.

Unlike current state of the art aircraft which are designed to communicate with the smart weapon 10 in accordance with predefined standards, the aircraft according to the present invention is not equipped to communicate with the particular type of smart weapon 10. For example, the aircraft may not include the aforementioned MIL-STD-1553 databus or any other type standard databus intended for communicating with a particular smart weapon 10. Moreover, the aircraft may not have the necessary control systems to provide the MIL-STD-1760 control to the smart weapon 10, for example.

The umbilical cable 18 of the present invention, on the other hand, allows such an aircraft to nevertheless control and utilize the smart weapon 10. As will be described in more detail below, the umbilical cable 18 includes at one end of a piece of cabling 20 a first connector 22 configured to connect to the aircraft. Typically, the connector 22 mates to a connector 24 included in the pylon 14. The umbilical cable 18 further includes a second connector 26 at the other end of the cabling 20. The second connector 26 is designed to mate with the connector 28 included in the smart weapon 10. As is typical, the second connector 26 is designed to disconnect or release from the connector 28 upon the smart weapon 10 being released from the bomb rack 16. As will be appreciated, the first and second connectors 22 and 26 (and mated connectors) may each include multiple sub-connectors as needed to properly connect to the aircraft/weapon.

Since the aircraft in accordance with the present invention is not originally equipped to communicate with the smart weapon 10 via a standard smart weapon communications interface, the aircraft instead provides a non-standard combination of signals to the smart weapon 10 via the umbilical cable 18. More specifically, the umbilical cable 18 of the present invention makes it possible for the aircraft simply to provide a combination of conventional "dumb" weapon power and control signals (e.g., 28 volts power lines, Master Arm signal, Nose Arm signal, Tail Arm signal, etc.), yet still carry out smart weapon operations. Such conventional signals are typically available at the pylon 14/bomb rack 16 interface. The connector 24 in the pylon 14 may be hardwired easily to include these signals and to provide the signals to the smart weapon 10 via the umbilical cable 18. This non-standard combination of signals is not receivable directly by the smart weapon so as to enable the smart weapon to carry out operations According to the present invention, however, the umbilical cable 18 includes an interface circuit 30 coupled between the first connector 22 and the second connector 26 via the wires within the cabling 20. The interface circuit 30 is configured to receive the non-standard combination of signals from the aircraft and to convert the non-standard combination of signals to a set of signals receivable by the smart weapon 10 to carry out operations. Moreover, the interface circuit 30 is configured to provide the set of receivable signals to the smart weapon 10. Further, the umbilical cable 18 and interface circuit 30 may be designed to control or manipulate certain specific circuits in the aircraft by electrically toggling voltages or ground, depending on these specific functions and requirements.

The types of aircraft which will benefit most from the present invention do not have standardized smart weapon interfaces. The umbilical cable 18 and the interface circuit 30 therein must be configured for the specific aircraft. The interface 30 is designed to utilize crew controlled circuits which are typically available, to provide for basic weapon required commands. Depending on the particular aircraft, discrete signals such as Nose Arm, Tail Arm, Station Select and Rocket Select can be sensed by the interface circuit 30 to control functions such as preprogrammed target selection or ballistic release override.

As is described in more detail below, the umbilical cable of the present invention may be used to allow a tactical aircraft to control many different types of weapons, which the aircraft would not otherwise be capable or equipped to control. An exemplary yet main weapon type intended for the application of this invention are those of the MIL-STD 1760 type. These weapons are designed to operate controlled by a standardized set of electrical power and signal circuits, including MIL-STD-1553 data bus commands. As such, the interface circuit in the umbilical cable described by the invention is designed to provide the complete 1553 data bus control command sequences required by a particular weapon. This self contained 1553 capability is a feature of the invention. Inputs to this circuitry from the aircraft are either operating power inputs or "generic data inputs" such as navigation information which is interpreted and translated by the stand alone umbilical cable control circuitry. Additionally, the umbilical cable circuitry can be designed to accept and react to specific existing aircraft signals normally present at weapon electrical interfaces, such as Master Arm, Nose Arming, Tail Arming, Normal Release, etc. These discrete voltage signals would be used to provide the pilot with direct control over specific aspects of the weapon control sequence process, from both the operational and safety aspects as required by prudent design guidelines. These circuit inputs would normally be inputted to the umbilical cable control circuitry, where the presence or absence of their voltage would be interpreted by the imbedded software and key the appropriate 1760 output to the weapon, whether that output be a discrete signal such as 28VDC#2 or a specific sequence of 1553 commands to the weapon's data bus input pins.

Figure 2:
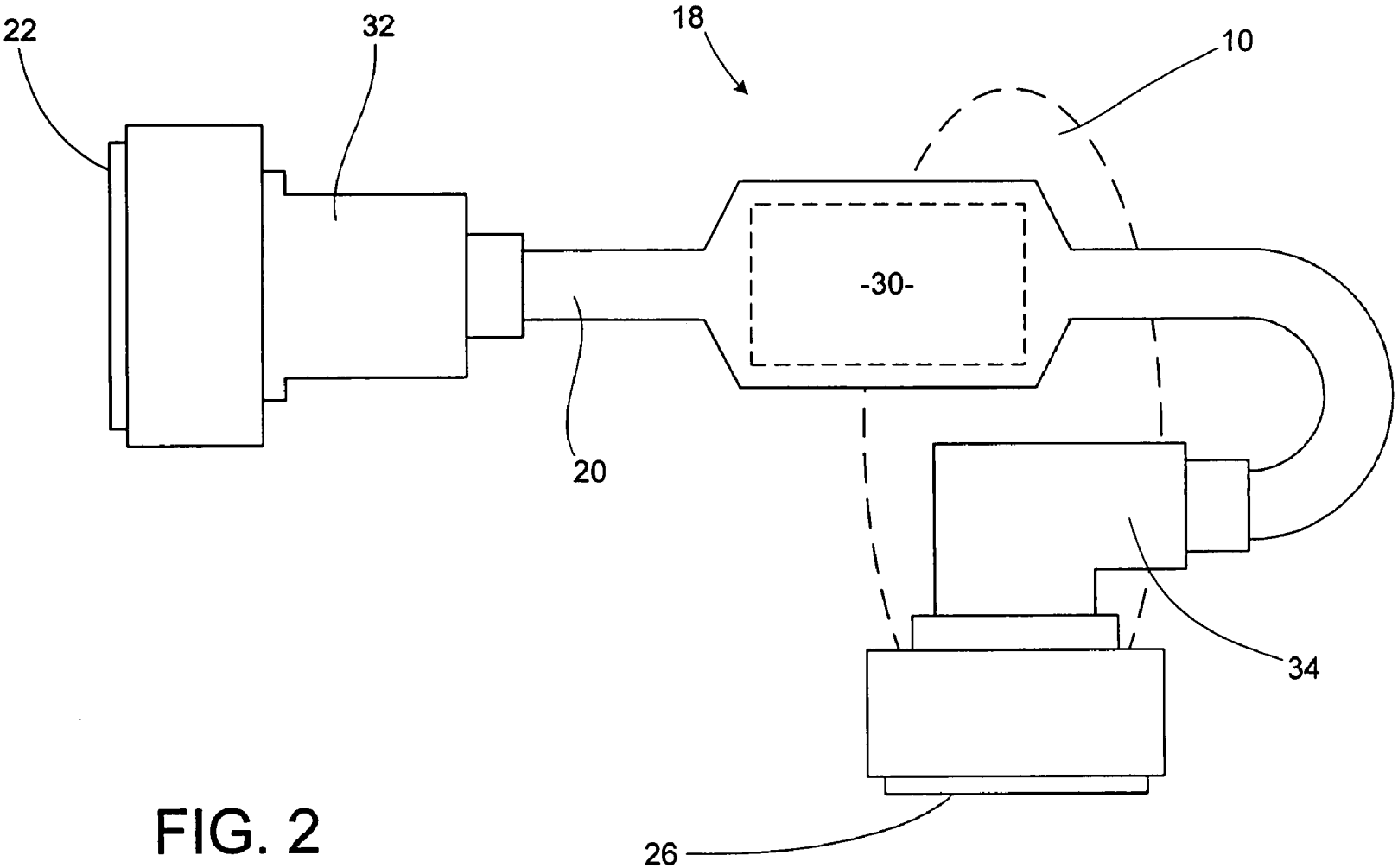
FIG. 2 is a schematic illustration of a smart weapon umbilical cable in accordance with an embodiment of the present invention.

Referring briefly to FIG. 2, the umbilical cable 18 is shown in more detail. The umbilical cable 18 is typically on the order of about 1½ to 2 feet long. The cabling 20 includes appropriate conductive wires for coupling signals between the aircraft/connector 22 and the smart weapon 10/connector 26, as will be appreciated. In the exemplary embodiment, the interface circuit 30 is disposed approximately midway within the cabling 20 in what will typically be an expanded portion of the cabling. In an alternate embodiment, the interface 30 may be located elsewhere in the umbilical cable 18 as is discussed below in association with FIG. 9, for example. The connectors 22 and 26 include backshells 32 and 34, respectively, as are known in the art.

Figure 3:
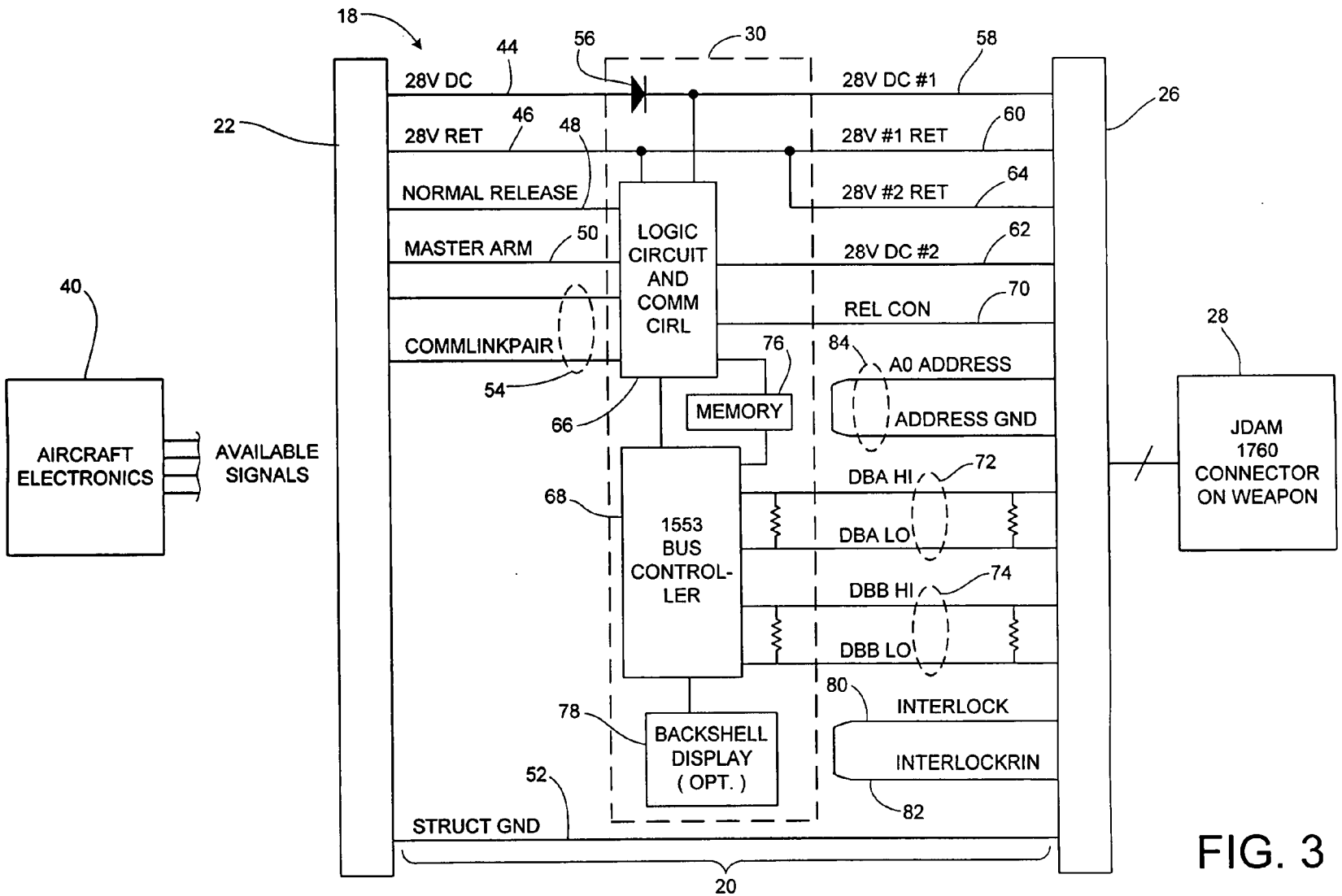
FIG. 3 is an electrical schematic of a smart weapon umbilical cable in accordance with an embodiment the present invention.

FIG. 3 represents an exemplary embodiment of the umbilical cable 18 in accordance with the invention. In this example, the aircraft electronics (represented generally by block 40) are capable of providing conventional "dumb weapon" discrete control signals referred to as Normal Release, and Master Arm. In addition, the electronics 40 are capable of providing 28 volts DC. Each of these control signals and power signals is coupled to the umbilical cable 18 via the connector 22 coupled to the aircraft. As an additional option, a simple communication link such as a two wire databus may be present in the aircraft and provided to the umbilical cable 18. Alternatively, the aircraft may be modified at relatively small expense to provide such simple type communication link. As will be appreciated, the particular combination of non-standard signals which the aircraft provides to the umbilical cable 18 will depend largely on the particular signals available in the aircraft and the particular level of control desired with the smart weapon 10.

As is shown in FIG. 3, the aircraft provides a supply voltage of 28 VDC and a supply voltage return to the umbilical cable 18 on lines 44 and 46, respectively, via the connector 22. In addition, the aircraft provides a Normal Release signal on line 48 and a Master Arm signal on line 50. The Normal Release signal is a signal derived from the pilot's weapon release button, and is found even in aircraft not equipped to handle smart weapons. The Master Arm signal is a signal derived from the pilot's master arm button which signifies a request to arm the weapon. The Master Arm signal is also found even in aircraft not equipped to handle smart weapons.

A structural ground is provided on line 52 of the umbilical cable 18. The structural ground typically is acquired from the body of the aircraft via contact with the connector 22. As mentioned above, the aircraft may optionally provide some type of data communication link to the umbilical cable 18 such as a two-wire communication link 54. For reasons explained below, such a communication link 54 is not necessary, but can expand the operations of the smart weapon 10.

The interface circuit 30, shown in more detail in FIG. 3, is designed to convert the non-standard combination of signals provided by the aircraft into a set of signals which may be used to operate the smart weapon 10. The specific configuration of the interface circuit 30 will depend largely on the particular signals provided by the aircraft and the design of the smart weapon, as will be appreciated. However, those having ordinary skill in the art will appreciate based on the disclosure presented herein how to configure such an interface circuit 30 for a given aircraft and weapon 10 in accordance with the present invention. Thus, while a particular configuration of the interface circuit 30 is described herein, it will be appreciated that the present invention is not intended to be limited thereto.

In the exemplary embodiment, the interface circuit 30 receives the supply voltage on line 44. The interface circuit 30 includes a reverse polarity diode 56 thru which the supply voltage is passed, and the interface circuit 30 provides the supply voltage to the smart weapon 10 via line 58 coupled to the connector 26. In this manner, the aircraft is capable of providing operating power to the smart weapon 10. Should the smart weapon 10 operate on a voltage other than that available from the aircraft, the interface circuit 30 may include an appropriate voltage converter as will be appreciated.

The supply voltage return on line 46 passes thru the interface circuit 30 and is provided to the smart weapon 10 via line 60 coupled to the connector 26. In the case where the smart weapon 10 is a JDAM as in the exemplary embodiment, the connector 26 is designed to mate with a JDAM MIL-STD-1760 type connector on the smart weapon 10. The MIL-STD-1760 weapon interface standard requires a primary and a secondary 28 VDC power circuit. The primary power circuit is essentially continuously providing constant, steady DC power for internal weapon circuitry. The secondary 28VDC power circuit is not constant, but must be closely controlled. The secondary power circuit is to be powered only if the weapon is properly prepared for release, and also only if release is imminent. In order to provide proper weapon control, the interface circuit 30 is designed to activate and deactivate the secondary power output circuit as required.

Thus, in addition to lines 58 and 60, the umbilical cable 18 provides a second supply voltage to the connector 26 via line 62, an a second supply voltage return via line 64. The second supply voltage on line 62 is provided via a logic circuit and communication control section 66 included in the interface circuit 30. The logic circuit and communication control section 66 is designed to activate and deactivate the secondary power output on line 62 as required for proper weapon control. The interface circuit 30 may provide the second return line 64 simply by tapping off line 60.

As mentioned above, the interface circuit 30 includes the logic circuit and communication control section 66 as shown in FIG. 3. In addition, the interface circuit 30 includes a bus controller 68 coupled to the logic circuit and communication control section 66. The logic circuit and communication control section 66 includes appropriate logic and circuitry for receiving and processing the non-standard combination of signals from the aircraft. Specifically, the logic circuit and communication control section 66 is designed to convert the non-standard combination of signals from the aircraft into a format compatible with the particular bus controller 68 and interface (e.g., MIL-STD-1760) conventionally used by the smart weapon 10.

The logic circuit and communication control section 66 may be configured to provide any appropriate discrete signals directly to the smart weapon 10. Such discretes include, for example, a Release Consent control signal as represented on line 70. The Release Consent control signal according to the MIL-STD-1760 standard is analogous to the Master Arm signal on line 50, and may be generated based thereon.

Regarding data communications, the logic circuit and communication control section 66 compiles data and control information to the extent necessary from the non-standard combination of discretes (e.g., Normal Release) and the communication link 54. The logic circuit and communication control section 66 provides the data in an appropriate format to the bus controller 68 so it may in turn be provided to the smart weapon 10. In the exemplary embodiment, the bus controller 68 is a MIL-STD-1553 databus conventionally used to communicate with the JDAM via the MIL-STD-1760 interface. The bus controller 68 is coupled to the interface via redundant databuses 72 and 74 standard in the MIL-STD-1760 interface.

The logic circuit and communication control section 66 and the bus controller 68 have been described primarily in terms of communications from the aircraft to the smart weapon 10. However, it will be appreciated that the control section 66 and bus controller 68 also can provide for bidirectional communications between the aircraft and the smart weapon 10. For example, the smart weapon 10 can provide operation status, fault information, etc., via the bus controller 68 and the control section 66.

The interface circuit 30 also includes a memory 76 coupled to the logic circuit and communication control section 66 and/or the bus controller 68. The memory 76 serves to store relevant data, such as target coordinates, necessary for the operation of the smart weapon. In addition, the memory 76 may serve as a working memory for the control section 66 and/or the bus controller 68.

Furthermore, the interface circuit 30 may include an optional display 78 for displaying relevant information. For example, the display 78 may be used to display target coordinate data which is programmed into the smart weapon 10 as described more fully below.

The logic circuit and communication control interface 66 and the bus controller 68 may be made of discrete components and/or an application specific integrated circuit (ASIC). As mentioned above, the particular design of the logic circuit and communication control interface 66 and the bus controller 68 will be appreciated by those having ordinary skill in the art in view of the particular signals available to the smart weapon 10 from the aircraft via the umbilical cable 18 and the desired degree of control. Therefore, detail as to the specifics of such circuitry has been omitted for sake of brevity. The logic circuit and communication control interface 66 and the bus controller 68 each may derive their necessary operating power from the supply voltage provided via lines 44 and 46, as will be appreciated.

The umbilical cable 18 as shown in FIG. 3 also includes interlock and interlock return lines 80 and 82, respectively, coupled to the connector 26. In the exemplary embodiment, lines 80 and 82 are hardwired together within the cable 18. Continuity between these two lines informs the smart weapon 10 that it is connected to the aircraft umbilical cable 18. Alternatively, the logic circuit and communication control section 66 can be configured to sense a connection of the connector 22 to the aircraft and the connector 26 to the smart weapon 10 as a condition precedent to providing continuity between lines 80 and 82.

Furthermore, the umbilical cable 18 includes addressing lines 84. The addressing lines may be hardwired within the cable 18 via jumpers or the like to define a fixed address for the smart weapon 10. Alternatively, in the case where dynamic addressing is utilized, the addressing lines 84 may be coupled to bus controller 68 which in turn outputs the appropriate addressing.

Figure 4:
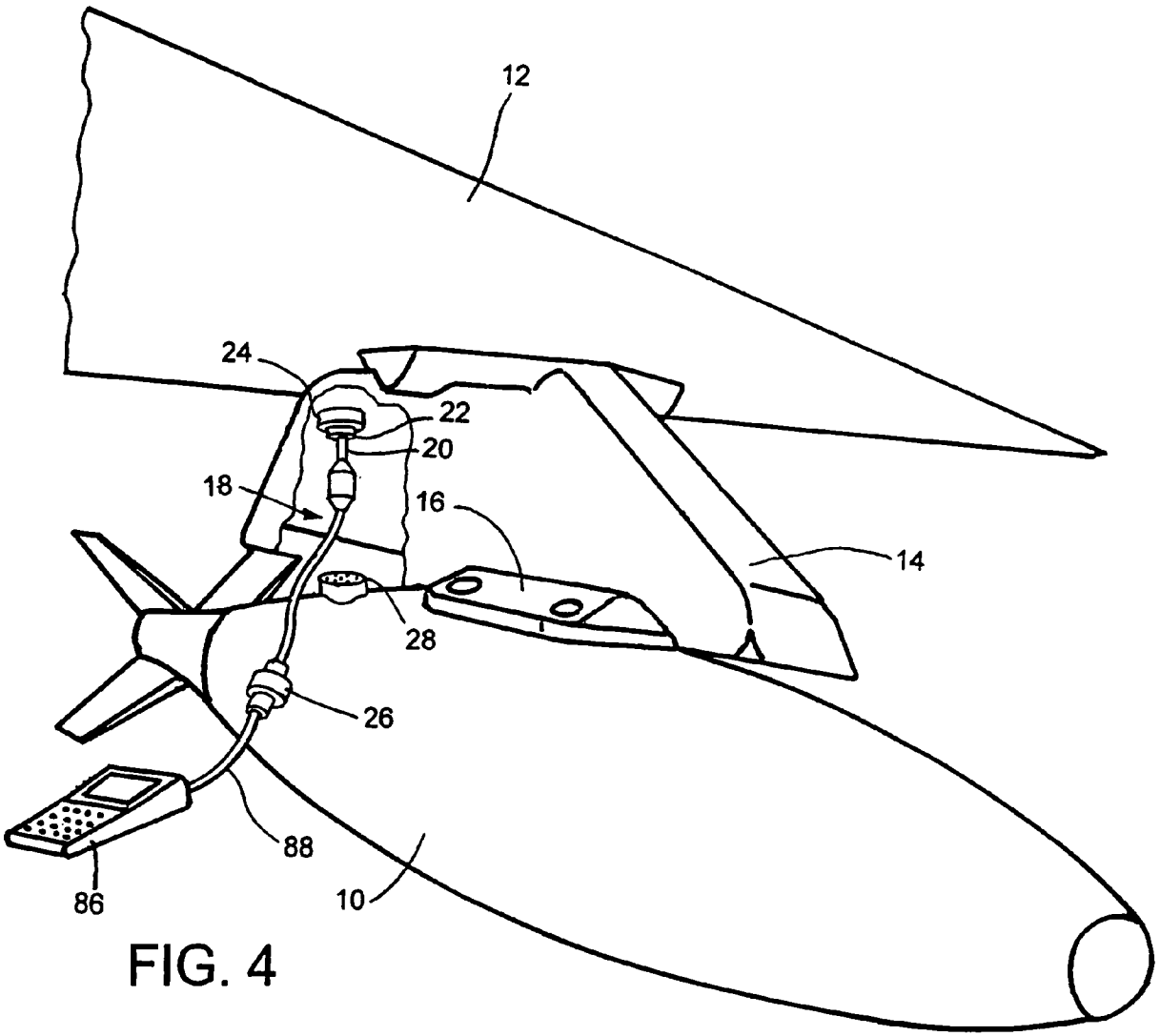
FIG. 4 illustrates a ground loading device communicating with the smart weapon via the umbilical cable in accordance with an embodiment of the present invention.

A basic manner for operating the smart weapon 10 provides for ground loading of target data (e.g., target coordinates). Referring to FIG. 4, target data is loaded into the umbilical cable 18 by temporarily coupling the connector 26 at the weapon end of the umbilical cable 18 to a ground loading device 86. The smart weapon 10 may be mounted to the aircraft at the time. The umbilical cable 18 need not be coupled to the smart weapon 10. The target data is simply loaded into the umbilical cable 18 using the ground loading device 86, and is stored in the memory 76. Preferably the umbilical cable 18 remains connected at the opposite end to the aircraft via connector 22. This minimizes the possibility of targeting errors. Once the ground loading device 86 loads targeting data into the umbilical cable 18, the umbilical cable 18 is subsequently connected to the smart weapon 10. The target data thus previously loaded in the umbilical cable 18 is then provided to the smart weapon 10 from the umbilical cable 18 during normal aircraft operation.

The ground loading device 86 may be a computer, preferably of the handheld variety. The ground loading device 86 is programmed to provide target data such as target coordinates to the umbilical cable 18 according to a predefined format. The ground loading device 86 preferably is coupled to the smart weapon end of the umbilical cable 18. However, an alternate embodiment may utilize the aircraft end of the cable 18 to program the umbilical cable 18 via the communication link 54.

Specifically, the ground loading device 86 includes an input/output port with a cable 88 designed to mate to the connector 26. The ground loading device 86 provides the target data to the logic circuit and communication control section 66 via databuses 72 and 74 in accordance with the bus controller 68 protocol. In the exemplary embodiment, the control section 66 stores the target data in the memory 76. These commands are then provided to the smart weapon 10 via the databuses 72 and 74 during normal aircraft operation. The various discretes provided by the aircraft can serve as possible inputs for specific sequence initiation, target alternatives, etc.

Accordingly, the embodiment of FIG. 4 allows for ground personnel to program target data for the smart weapon via the umbilical cable 18. Such operation is advantageous as virtually no aircraft modifications are necessary. The discrete control signals necessary from the crew in flight are available already at the pylon or bomb bay as described above. Thus, virtually any aircraft can be made smart weapon capable at very little expense using the umbilical cable 18 of the present invention.

In the event it is desirable to provide in-flight pilot targeting control, a simple communication link (e.g., non-MIL-STD-1553) such as a two-wire bus for the aforementioned two-wire communication link 54 may be added to the aircraft at relatively minimal expense. This allows the pilot to target or retarget the smart weapon 10 while in flight.

Figure 5:
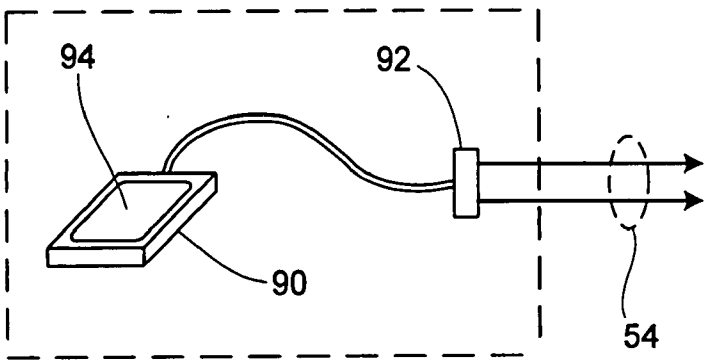

For example, FIG. 5 illustrates an embodiment in which a two-wire bus (labeled as corresponding communication link 54) is run from the cockpit of the aircraft to the pylon connector 24. The pilot may have a portable hand-held processor device 90 such as a commonly available personal digital assistant (PDA) from Palm (e.g., the Palm Pilot™), Casio, Dell, etc. The PDA device 90 includes an I/O port which is hardwired via an appropriate interface 92 to the communication link 54. This allows the pilot to input relevant data such as target data (e.g., coordinate data) or the like. The PDA device 90 may be strapped to the knee of the pilot, and be configured to allow the pilot to input the data via a touchscreen 94 or the like. The umbilical cable 18 receives the data via the communication link 54, and converts the data to a set of signals receivable by the smart weapon 10. In this manner, full in-flight re-targeting capability is provided.

Figure 6:
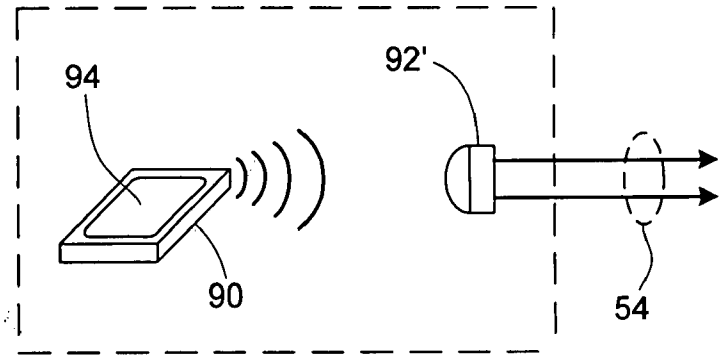
FIGS. 5, 6 and 7 represent different ways for providing communications between the aircraft and the smart weapon via the umbilical cable in accordance with respective embodiments of the present invention.

FIG. 6 illustrates a variation of the embodiment of FIG. 5. In this embodiment, the PDA device 90 is wirelessly linked to the communication link 54. More specifically, the PDA device 90 may include a small infrared (IR), radio frequency (RF) or other type I/O port. Located preferably inside the cockpit is an appropriate interface 92' for receiving and transmitting wireless communications between the interface circuit 30 in the umbilical cable 18 and the PDA device 90.

Figure 7:
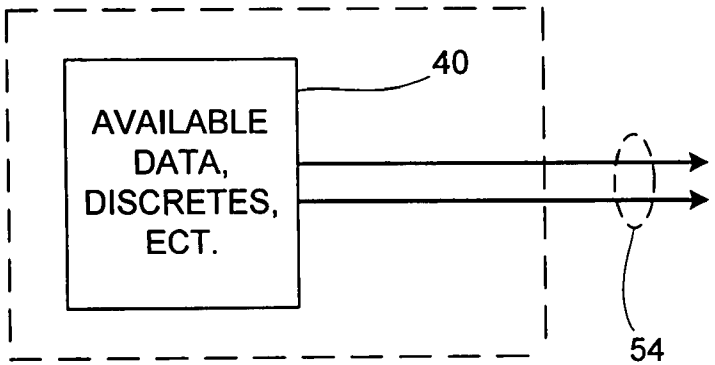

FIG. 7 generically represents the feature of the invention whereby any available data, discrete signals, etc. from the aircraft may serve as the source of the non-standard combination of signals provided to the umbilical cable 18. For example, navigation data, GPS data, altitude data, air speed data, etc. all may be provided to the smart weapon 10 as needed. The information may be hardwired to the connector 24, or sent via a communication link 54 either automatically, if configured, or by manual entry by the pilot as described above in connection with FIGS. 5 and 6. The umbilical cable 18 is designed, with knowledge of the particular information available from the aircraft and the particular smart weapon involved, the convert the information into a set of signals receivable by the smart weapon 10 in order to carry out operations.

Figure 8:
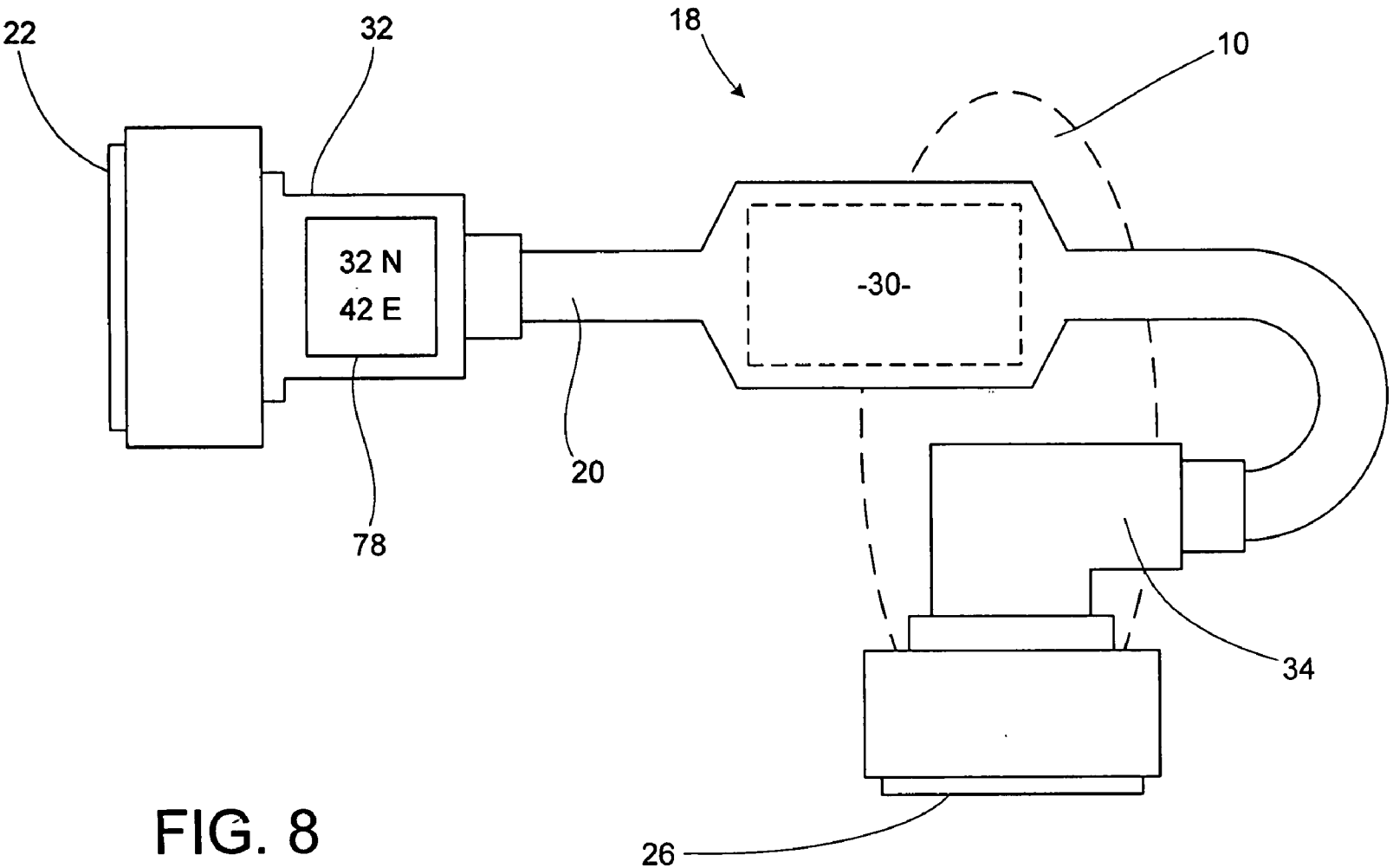
FIG. 8 illustrates an umbilical cable with a built-in display in accordance with another embodiment of the present invention.

FIG. 8 illustrates another alternative embodiment of the present invention. In this embodiment, the umbilical cable 18 includes the display 78 (see, FIG. 3) in the backshell 32 of the connector 22. The display 78 is useful, for example, in providing verification of the target data stored in the memory. For example, when the umbilical cable 18 is loaded with target data in the manner described above in relation to FIG. 4, the target data may be verified even after the umbilical cable 18 is disconnected from the ground loading device 86 and reconnected to the weapon. Additionally, or in the alternative, the display 78 may be used to display status information, fault information, or the like provided by the internal cable circuitry.

The display 78 may be any type of display (e.g., numeric, alphanumeric, simple status indicator lights, etc.) without departing from the scope of the invention. The display 78 may be an liquid crystal display (LCD), light emitting diode (LED) display, or any other type of suitable display. Although the display 78 is shown as being located in the backshell 32 of the connector 22, it could instead be located in the backshell 34, or elsewhere along the umbilical cable 18 without departing from the scope of the invention as will be appreciated.

Figure 9:
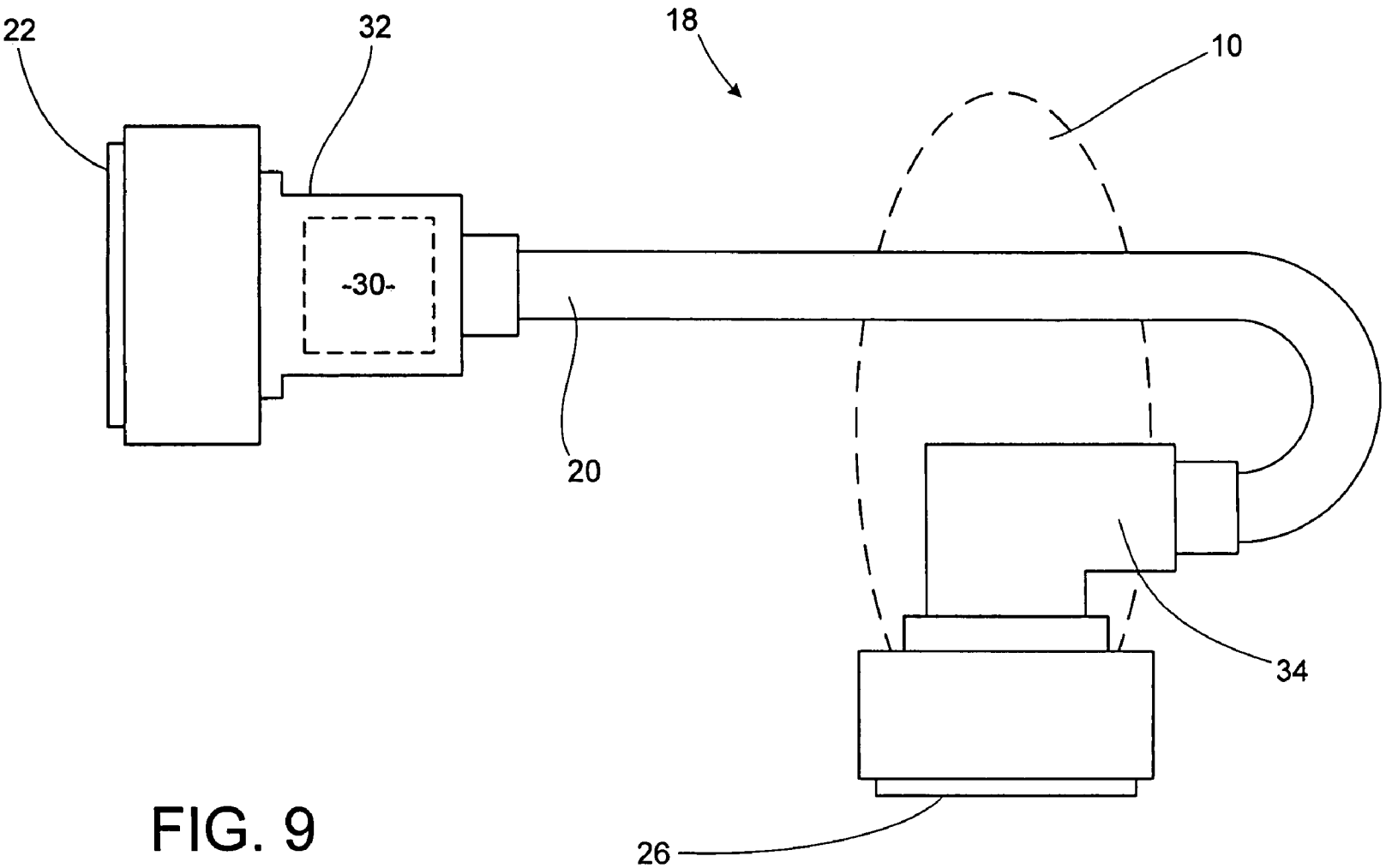
FIG. 9 illustrates still another embodiment of the umbilical cable of the present invention.

The umbilical cable 18 is described above with the interface circuit 30 being located approximately in the middle of the cable. It will be appreciated, however, that the interface circuit may be located elsewhere within the cable 18 without departing from the scope of the invention. For example, FIG. 9 illustrates an embodiment in which the interface circuit 30 is located in the backshell 32 of the connector 22. In another embodiment, the interface circuit 30 may be included in the backshell 34 of the connector 26. Further still, another embodiment may include the interface circuit 30 split and located in the back shells 32 and 34 of both connectors. Any of these embodiments may include a display 78 also.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

What is claimed is:

1. An umbilical cable for delivering electrical signals between an aircraft and a smart weapon carried by the aircraft, the umbilical cable comprising:

cabling comprising a plurality of conductive wires;

a first connector provided on one end of the cabling and configured to connect to the aircraft;

a second connector provided on the other end of the cabling and configured to connect to the smart weapon; and an interface circuit electrically coupled between the first connector and the second connector via the plurality of conductive wires, the interface circuit being configured to receive via the first connector a non-standard combination of signals comprising at least one of data signals, control signals and power signals not receivable directly by the smart weapon to carry out operations, to convert the non-standard combination of signals to a set of signals receivable by the smart weapon to carry out operations, and to provide the set of receivable signals to the smart weapon via the second connector, wherein the combination of signals which the interface circuit is configured to receive is not representative of a standardized smart weapon interface.

2. The umbilical cable of claim 1, wherein the non-standard combination comprises discrete signals from the aircraft.

3. The umbilical cable of claim 1, wherein the interface circuit comprises a memory for storing a sequence of control commands for operating the smart weapon, and a bus controller for providing the sequence of control commands to the smart weapon.

4. A system comprising the umbilical cable of claim 1, and further comprising:

source operation circuitry for providing the non-standard combination of signals to the first connector.

5. The system of claim 4, wherein the aircraft comprises an aircraft connector designed to mate with the first connector, and the source operation circuitry comprises at least one hardwired connection of a discrete control signal from elsewhere in the aircraft to the aircraft connector.

6. The system of claim 5, wherein the discrete control signal comprises at least one of a release signal representing a desired release of the smart weapon, and a master arm signal representing a desire to arm the smart weapon.

7. The system of claim 5, wherein the source operation circuitry further comprises a communication bus which is coupled to a corresponding bus included within the umbilical cable.

8. The system of claim 7, wherein the communication bus is a two wire bus.

9. The system of claim 5, wherein the source operation circuitry further comprises a communication bus which is coupled to a corresponding bus included within the umbilical cable, the corresponding bus not being part of a standardized smart weapon interface.

10. The system of claim 4, wherein the source operation circuitry comprises a pilot-operated digital processor.

11. The system of claim 10, wherein the pilot-operated digital processor is portable.

12. The system of claim 11, wherein the pilot-operated digital processor is hardwired to an aircraft connector designed to mate with the first connector.

13. An umbilical cable for delivering electrical signals between an aircraft and a smart weapon carried by the aircraft, the umbilical cable comprising:

cabling comprising a plurality of conductive wires;

a first connector provided on one end of the cabling and configured to connect to the aircraft;

a second connector provided on the other end of the cabling and configured to connect to the smart weapon; and an interface circuit electrically coupled between the first connector and the second connector via the plurality of conductive wires, the interface circuit being configured to receive via the first connector a non-standard combination of signals comprising at least one of data signals, control signals and power signals not receivable directly by the smart weapon to carry out operations, to convert the non-standard combination of signals to a set of signals receivable by the smart weapon to carry out operations, and to provide the set of receivable signals to the smart weapon via the second connector, wherein the pilot-operated digital processor is portable and the pilot-operated digital processor is wirelessly linked to an aircraft connector designed to mate with the first connector.

14. An umbilical cable for delivering electrical signals between an aircraft and a smart weapon carried by the aircraft, the umbilical cable comprising:

cabling comprising a plurality of conductive wires;

a first connector provided on one end of the cabling and configured to connect to the aircraft;

a second connector provided on the other end of the cabling and configured to connect to the smart weapon;

an interface circuit electrically coupled between the first connector and the second connector via the plurality of conductive wires, the interface circuit being configured to receive via the first connector a non-standard combination of signals comprising at least one of data signals, control signals and power signals not receivable directly by the smart weapon to carry out operations, to convert the non-standard combination of signals to a set of signals receivable by the smart weapon to carry out operations, and to provide the set of receivable signals to the smart weapon via the second connector; and a ground loading device separate from the aircraft and configured to connect to at least one of the first connector and the second connector to program operation data for the smart weapon into the umbilical cable.

15. The system of claim 14, wherein the ground loading device programs target coordinate data into the umbilical cable.

16. The system of claim 15, wherein the umbilical cable includes a memory for storing the target coordinate data programmed into the umbilical cable by the ground loading device.

17. The system of claim 14, wherein the umbilical cable further includes a display for displaying at least a portion of the operation data programmed into the umbilical cable.

18. The system of claim 17, wherein the display is included in a backshell of at least one of the first connector and the second connector.

19. A method of providing operation data to a smart weapon configured to be loaded on an aircraft, the method comprising the steps of:

providing an umbilical cable, the umbilical cable comprising:

cabling comprising a plurality of conductive wires;

a first connector provided on one end of the cabling and configured to connect to the aircraft;

a second connector provided on the other end of the cabling and configured to connect to the smart weapon; and an interface circuit electrically coupled between the first connector and the second connector via the plurality of conductive wires, the interface circuit being configured to receive via the first connector a combination of signals comprising at least one of data signals, control signals and power signals not receivable directly by the smart weapon to carry out operations, to convert the combination of signals to a set of signals receivable by the smart weapon to carry out operations, and to provide the set of receivable signals to the smart weapon via the second connector;

temporarily connecting at least one of the first connector and the second connector to a ground loading device separate from the aircraft; and transmitting the operation data from the ground loading device to the umbilical cable and storing the operation data within the umbilical cable.

20. The method of claim 19, further comprising the steps of connecting the first connector to the aircraft, connecting the second connector to the smart weapon, and providing the operation data stored within the umbilical cable to the smart weapon during operation of the aircraft.

21. The method of claim 19, wherein the method is carried out while the umbilical cable is connected at one end to the aircraft.

22. The method of claim 19, wherein the ground loading device provides target coordinate data to the umbilical cable.

23. The method of claim 19, wherein the umbilical cable further includes a display and displays at least a portion of the operation data stored in the umbilical cable.

24. The method of claim 23, wherein the display is included in a backshell of at least one of the first connector and the second connector.

25. The method of claim 19, wherein the umbilical cable supports bi-directional communication between the smart weapon and the ground loading device.

26. The method of claim 19, wherein the operation data transmitted from the ground loading device to the umbilical cable and stored in the umbilical cable is transmitted from the ground loading device into the umbilical cable by coupling the ground loading device to an end of the umbilical cable not concurrently connected to the aircraft.

* * * * *